US005979325A

United States Patent [19]

Mitze et al.

[11] Patent Number: 5,979,325

[45] **Date of Patent: *Nov. 9, 1999**

[54] DRYER UNIT IN A PRINTING MACHINE

[75] Inventors: Rudolf Mitze, Dietzenbach; Wolfgang Mohr, Halstenbek, both of Germany

[73] Assignee: MAN Roland Druckmashinen AG, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/989,011

[22] Filed: Dec. 11, 1997

[30] Foreign Application Priority Data

Dec. 11, 1996 [DE] Germany ..... 196 51 406

[51] Int. Cl.[6] ..... B41L 35/14

[52] U.S. Cl. ..... 101/488; 101/487

[58] Field of Search ..... 101/488, 487, 101/424.1, 419, 416.1; 34/273

[56] References Cited

U.S. PATENT DOCUMENTS

| | | | |
|---|---|---|---|
| 3,900,959 | 8/1975 | Breschi et al. | 34/155 |
| 4,572,071 | 2/1986 | Cappel et al. | 101/183 |
| 4,811,493 | 3/1989 | Burgio | 34/4 |
| 4,882,852 | 11/1989 | Kautto | 34/273 |
| 5,092,059 | 3/1992 | Wimberger et al. | 34/156 |

FOREIGN PATENT DOCUMENTS

| | | | |
|---|---|---|---|
| 0 035 741 | 4/1984 | European Pat. Off. . | |
| 2 417 441 | 11/1974 | Germany . | |
| 34 11 029 | 10/1987 | Germany . | |
| 92 14 459 | 3/1993 | Germany . | |
| 93 10 028 | 11/1993 | Germany . | |
| 38 28 753 | 5/1994 | Germany . | |
| 43 08 276 | 9/1994 | Germany . | |
| 2096294 | 10/1982 | United Kingdom | 101/424.1 |
| WO 95/01930 | 1/1995 | WIPO . | |

*Primary Examiner*—Edgar Burr
*Assistant Examiner*—Anthony H. Nguyen
*Attorney, Agent, or Firm*—Leydig, Voit & Mayer, Ltd.

[57] ABSTRACT

A dryer unit which is integrated as a module into a printed material guide system of a printing machine in order to facilitate two-sided drying of printed material is provided. The printed material guide system includes a guide surface which has a plurality of openings and an air system which is selectively operable in positive or negative pressure modes to assist the guiding of the printed material. The dryer module is arranged in an opening in the guide surface such that it heats at least one side of the printed material. At least one outlet opening is associated with the dryer module. The outlet opening is open into the plane of the guide surface and is coupled to a cooling system which is operable to provide cooling air to the dryer module.

13 Claims, 1 Drawing Sheet

DRYER UNIT IN A PRINTING MACHINE

FIELD OF THE INVENTION

This invention generally relates to printing machines and, more particularly, to a dryer unit for an offset printing machine.

BACKGROUND OF THE INVENTION

Drying units are used in offset printing machines to dry and/or cure the ink or varnish which is applied to the sheet or web material. One such dryer unit is disclosed in EP 0 035 741 Bl. Specifically, this reference discloses a sliding table having a cooling surface which is arranged opposite a dryer device. The sliding table acts as a printed material guide system and is arranged with its cooling surface facing the unprinted side of the printed material. In order to dry the printed material, which is described as a thermoplastic sheet material, the dryer device blows air in the direction of the cooling surface. The printed material guide system further includes coolant ducts which are connected to a cooling system comprising a heat exchanger and circulating pump.

A deliverer in a sheet-fed printing machine which has dryer devices arranged in a modular construction within the chain conveyor system is disclosed in PCT/WO 95-01930. Air assisted printed material guide systems are arranged opposite the dryer devices and underneath the sheet conveying path.

Another dryer unit is disclosed in DE 92 14 459 Ul. This particular dryer unit is constructed with a cooling system which includes a heat exchanger, a flow monitor, a compensation container and a circulation pump. The cooling system further includes a coolant line interconnecting the circulation pump and a sheet guide plate which provides coolant to the sheet guide plate. In addition, the coolant outlet of the sheet guide plate can be coupled by means of a connecting line to a dryer unit positioned opposite the sheet guide plate in order to also provide coolant to the dryer unit. The cooling of the dryer unit and the sheet guide plate prevents heat from building up within the printing machine. In order to accelerate the oxidative drying of the printing inks, the printed material itself is heated by means of infrared radiation.

DE 43 08 276 Al also discloses a sheet guide device having a cooling device which cools the sheet guide surface when a dryer unit is operating. The sheet guide surface has a plurality of openings through which air is blown. One of the openings is formed by an end face integrated in the sheet guide surface as an impact face and includes a flow duct which opens at an angle into the sheet guide surface. The cooling device is configured as a cooling trough having a trough bottom and a lid wherein the lid of the trough constitutes the sheet guide plate.

One of the significant problems with these designs is that the dryer units are always arranged opposite the printed material guide system. Thus, the printed material is dried only from one side (the front side). This leads to problems in the drying process including, for example, smearing (setting-off) of the ink and/or varnish which resulting from inadequately dried printed materials reaching the deliverer stack.

A drying device for printed products which is arranged to dry both the front and rear side of the printed material is disclosed in DE 38 28 753 C2. The drying device includes an energy transmission device comprising a fiber optic cable and a rectilinearly fanned-out beam splitter device. The drying device is arranged on both sides of printed material in the sheet deliverer, however, and is not integrated with a sheet guide system.

OBJECTS AND SUMMARY OF INVENTION

Accordingly, in view of the foregoing, it is a general object of the present invention to provide a dryer system for a printing machine which substantially reduces the smearing of ink and varnish in the deliverer stack on printed material processed on either one or both sides.

A further object of the present invention is to provide a dryer system for a printing machine which can be integrated into the printed material guide system such that the printing machine can be easily configured to provide two-sided drying.

Another object of the present invention is to provide a drying system for a printing machine which reduces the drying time of the printed material and which also reduces the space required for the drying section in the printing machine.

The present invention provides these and other advantages and overcomes the drawbacks of the prior art by providing a drying system which includes a dryer module integrated into the printed material guide system. By enabling at least one side of the printed material to be dried at the same time it is guided, the present invention facilitates configuring the printing machine to provide two-sided drying. As compared to applying heat to only one-side of the printed material, two-sided drying substantially reduces smearing of the ink or varnish, particularly in the deliverer stack.

The printed material guide system includes a guide surface which has a plurality of openings and an air system which is selectively operable in positive or negative pressure modes to assist the guiding of the printed material. A dryer module is arranged in an opening in the guide surface and is adapted to dry at least one side of the printed material. Additionally, at least one outlet opening is associated with the dryer module. The outlet opening is open into the plane of the guide surface and is coupled to a cooling system which is operable to provide cooling air to the dryer module.

These and other features and advantages of the invention will be more readily apparent upon reading the following description of a preferred exemplary embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
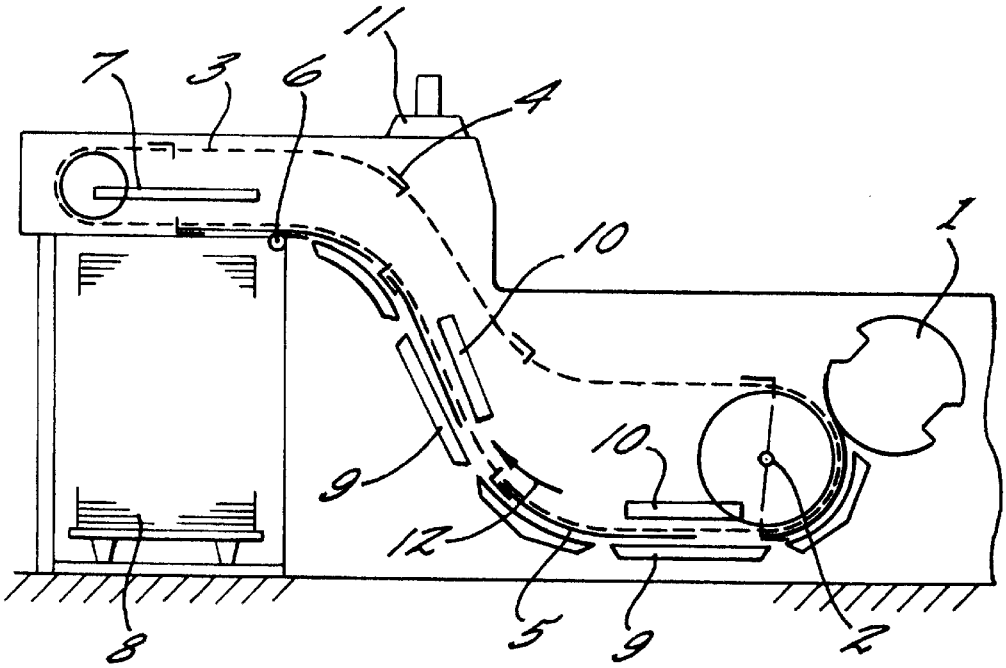
FIG. 1 is a schematic side view of a sheet deliverer having a drying system constructed in accordance with the teachings of the present invention.

FIG. 1 schematically illustrates a portion of an offset printing machine which incorporates a drying system constructed in accordance with the teachings of the present invention. The drying system of the present invention includes a dryer module which can be integrated into a printed material guide system for the printing machine and as such enables the printing machine to be easily configured to provide two-sided drying of the printed material. For example, the dryer module (or unit) and guide system of the present invention is particularly suitable for arrangement underneath the plane within which the printed material is conveyed. This arrangement results in the rear or back side of the printed material being dried at the same time it is guided. A conventional drying unit may then be provided to dry the front side of the printed material. As will be appreciated, the conventional drying unit assigned to dry the front side of the printed material may be arranged either directly opposite, upstream or downstream from the drying module integrated into the guide system. Alternatively, the combination dryer module and guide system of the present invention may be arranged to dry and guide the front side of the printed material or at least two guide systems with integrated dryer modules could be arranged opposite one another such that both sides of the printed material are guided and dried.

As compared to drying through heat applied to only one side of the printed material, two-sided drying significantly reduces the smearing of the printed material which is produced by the printing machine, particularly smearing which occurs in the deliverer stack. Two-sided drying also shortens drying times and improves the oxidative drying of the printed or varnished material as well as the absorption of the ink or varnish and the curing of the ultraviolet inks and varnishes. In addition, when sheets are utilized as the printed material, two-sided drying enables both sides of the printed sheets to be heated uniformly thereby preventing heat or cold bridges from forming between the individual sheets which otherwise could lead to smearing of the ink or varnish. Since with the present invention a dryer module is integrated into the printed material guide system of the printing machine, the overall length of the printed material conveying path which is dedicated to drying can also be reduced.

As will be appreciated, the dryer module and guide system combination of the present invention can be incorporated into offset printing machines which are equipped with any combination of printing units and varnishing units. For example, FIG. 1 illustrates a portion of an offset printing machine which has printing units for multi-colored printing and includes a turning unit and two varnishing units arranged downstream from the turning unit. In the illustrated embodiment, the printed material 5 comprises a sheet, however, it will be appreciated that the present invention is equally applicable to web-like printed material. Moreover, a variety of sheet or web materials may be used including, for example, paper, cardboard, plastic or metal films, plastic or metal foils, or metal.

In order to transport the printed material, a chain conveyor system 3 driven by a chain wheel shaft 2 and equipped with gripper devices 4 is provided. The chain conveyor system 3 circulates in the deliverer such that the printed material 5 is conveyed in a conveying direction 12 from a printing cylinder 1, which in the illustrated embodiment comprises part of the second varnishing unit, to a deliver stack 8. The printed materials 5 are deposited onto the deliverer stack 8 using a braking device 6 and a blower 7 which are arranged adjacent the deliverer stack. The deliverer is further equipped with a venting device 11 which is arranged generally on the top of the deliverer and acts to draw air away from the printing machine.

Figure 2:
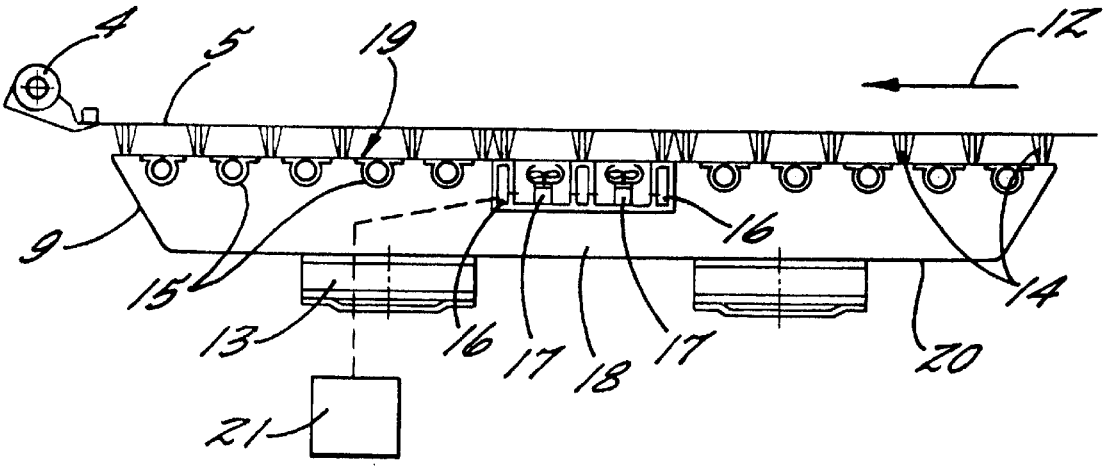
FIG. 2 is a schematic side view of a dryer module constructed in accordance with the teachings of the present invention integrated into a printed material guide system.

For the purpose of guiding the printed material as it is conveyed from the printing cylinder 1 to the deliverer stack 8, the illustrated sheet deliverer includes a printed material guide system 9. As shown in FIG. 1, the printed material guide system comprises a plurality of individual modules which are arranged approximately equidistant from each other and parallel to the conveying path defined by the portion of the chain conveyor system 3 between the printing cylinder 1 and the deliverer stack 8. As shown in FIG. 2, each module of the printed material guide system 9 essentially comprises what is generally referred to as a closed blower/suction box. The closed/blower suction box includes a box housing 20 and a guide surface 19 which faces the rear side of the printed material 5 and defines one side or the "lid" of the box housing 20. Blower/suction boxes of this type are disclosed in DE 34 11 029 C2, and its U.S. counterpart U.S. Pat. No. 4,572,071, both which are assigned to the assignee of the present invention and incorporated herein by reference.

In order to assist the guiding of the printed material, particularly at high conveying speeds, the printed material guide system 9 may be equipped with an air system 13. The air system 13 is selectively operable in either a positive pressure (blowing) mode or a negative pressure (suction) mode. In the positive pressure mode, the air system 13 provides a cushion of air which supports and guides the printed material 5. In the negative pressure mode, the air system 13 operates to draw the printed material 5 towards the guide surface 19 and thereby ensures positive contact between the guide surface 19 and the printed material 5. The negative pressure mode has particular application when the printed material guide system 9 is arranged opposite a transfer drum. In contrast, if the guide system 9 is arranged opposite a turning drum as opposed to a transfer drum, then the positive pressure mode of the air system 13 would be used to provide non-contact guiding of the printed side of the printed material 5. The air system 13, which may simply comprise a series of blowers, is arranged on the box housing 20, as shown in FIG. 2, and is operable through the plurality of openings 14 which are provided in the guide surface 19.

In order to dry the printed material as it is conveyed from the printing cylinder 1 to the deliverer stack 8, the illustrated deliverer is equipped with a plurality of dryer units each of which is assigned to dry either the front or back side of the printed material. In particular, the deliverer includes a plurality of dryer units 10 which dry the front side of the printed material and a plurality of dryer modules or units 18 integrated into individual modules of the printed material guiding system in accordance with the teachings of the present invention for drying the back side of the printed material. In the illustrated embodiment, each of the dryer units 10 is arranged adjacent a respective one of the modules of the printed material guide system 9 with one dryer unit 10 positioned adjacent the chain wheel shaft 2 just as the printed sheets begin the path from the printing cylinder 1 to the deliverer stack 8. A second dryer unit 10 is arranged downstream from the first dryer unit in the portion of the sheet conveying path where it ascends towards the deliverer stack 8.

To ease repair and replacement as well as to free up space within the printing machine, each of the dryer units 18 which heat the back side of the printed material are advantageously integrated in a modular construction into respective modules of the printed material guide system 9. In the illustrated embodiment, each dryer unit 18 comprises a module which includes a pair of infrared radiators 17 arranged in an opening in the guide surface 19 such that when the dryer unit 18 is activated the back side of the printed material is heated as it is guided over the guide surface 19. The relatively large opening in the guide surface 19 which is provided for the dryer unit 18 may be covered with a metal grill or the like which is permeable to warm air and integrated into the guide surface 19. Such a grill is particularly useful when the air system 13 is operating in negative pressure (suction) mode. Those skilled in the art will appreciate that other types of modular dryer units may be provided including a single infrared radiator or single or multiple ultraviolet radiators. The dryer unit 18 itself is preferably partitioned off from the other systems in the housing box 20, including the cooling system 15 described below and the pneumatic system 13. For example, the dryer unit 18 may be partitioned off from the other systems by a reflective metal sheet which would also help to concentrate the heat in the direction of the printed material. It will be appreciated that the dryer unit 18 may be arranged either centrally or eccentrically in the printed material guide system module. Additionally, more than one dryer unit 18 could also be provided in each module of the printed material guide system 9.

The dryer unit 18 and the guide system 9 are also equipped with a separate air cooling system in order to cool the dryer unit 18 when it is activated. Specifically, as shown in FIG. 2, each infrared radiator 17 also has an associated outlet opening 16 in the box housing 20. These outlet openings 16 are coupled to a separate air cooling system (schematically shown and referenced as 21 in FIG. 2) such that an externally produced air flow cools the infrared radiators 17 when they are activated. Additionally, the outlet openings 16 open into the plane of the guide surface 19 such that the air flow used to cool the infrared radiators 17 also can be used for guiding the printed material 5.

Those modules of the printed material guide system 9 which are arranged opposite a dryer unit 10 are also provided with a system for cooling the guide surface 19. In particular, a cooling system 15 is arranged inside the box housing just below the guide surface 19, as shown in FIG. 2, and is operable to draw away any heat build-up from the guide surface which may result from operation of the dryer units 10. In the illustrated embodiment, the ducts of the cooling system 15 are arranged in the areas between the openings 14 and actually form the lower or rear side of the guide surface 19. The cooling system generally comprises a heat exchanger, a flow monitor, a compensation container and a circulation pump which control the flow and temperature of a coolant, such as for example water, which flows through the cooling ducts. It will be appreciated that those modules of the printed material guide system 9 which are not arranged opposite or adjacent to a dryer unit do not need to be provided with a cooling system 15. For example, when the printed material guide system 9 is arranged adjacent a transfer or turning drum to provide intermediate drying, the guide system 9 can simply comprise a blower/suction box having an integrated dryer unit 18, an air system 13 and a guide surface 19 with a plurality openings 14.

Those skilled in the art will appreciate in operation sheet or web material is run through the printing machine and the finishing units and printed or varnished on one side or both sides. The printed material 5 is then fed to the deliverer stack 8 in the conveying direction 12 as shown in FIG. 1. If the printed material 5 is printed on only one side, then it is dried by at least one dryer unit 10 which is activated. The air system 13 and cooling system 15 of the printed material guide system 9 which is associated with the dryer unit 10 are also activated. Particularly, the air system 13 is operated in the negative pressure (suction) mode. Further, the dryer unit 18 integrated into the associated guide system 9 is actuated, so that in addition to heat provided by the dryer unit 10 on the front side (recto printing side) of the printed material, the unprinted rear side of the printed material 5 is also heated by the dryer unit 18. The heating provided by the dryer unit 18 reduces or eliminates the temperature differential between the front side and rear side of the printed material 5, and accordingly substantially reduces the smearing of the ink or varnish which results from heat/cold bridges in the deliverer stack 8. If a printed material 5 which is printed or varnished on only one side and has a relatively low basis weight, e.g. less than 150 g/m$^2$, is being processed, it is not necessary to actuate the dryer unit 18.

As with one sided-printing operations, if the printed material 5 is printed on both sides such as in a recto/verso printing operation, both the dryer unit 10 and the dryer unit 18 are actuated in order to dry the ink or varnish. Similarly, the cooling system 15 is activated, in order to cool the guide surface 19 of the printed material guide system 9. Unlike the situation where only one side of the printed material is printed, however, the air system 13 is operated in the positive pressure (blower) mode in order to provide a cushion of air to support and guide the printed material 5.

While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and the scope of the invention as defined by the following claims.

What is claimed is:

1. A sheet-fed printing machine comprising a printing cylinder, a sheet conveyor system having gripping devices each for gripping a leading edge of a respective sheet from said printing cylinder and transferring the sheets in a downstream direction, a sheet guide system which defines a guide surface designed to be contacted by and guide trailing ends of said sheets as the sheets are transferred by said sheet conveyor system gripping devices, said guide surface being formed with a plurality of openings, a dryer unit in the form of a module and arranged in at least one of said guide surface openings for heating sides of said printed sheets that contact and are guided by said guide surface as they are guided by said guide surface, and said sheet guide system including an air system for creating an air flow through at least some of said guide surface openings.

2. The invention as in claim 1 wherein the dryer unit includes a heating element, and a reflective metal sheet defining a partition about the heating element.

3. The invention as in claim 1 wherein the sheet guide system includes a housing with said guide surface defining one side of the housing.

4. The invention as in claim 3 in which said sheet guide system includes a cooling system for cooling the guide surface of the sheet guide system.

5. The invention as in claim 4 wherein the guide surface has a rear side and the guide surface cooling system includes ducts which form part of the rear side of the guide surface.

6. The invention as in claim 1 wherein the dryer unit includes at least one infrared radiator.

7. The invention as in claim 1 wherein the dryer unit includes at least one ultraviolet radiator.

8. The invention as in claim 1 including an air system for creating an air flow through at least some of said guide surface openings.

9. The invention as in claim 1 in which said guide system includes a cooling system for providing cooling air to the dryer unit.

10. The invention as in claim 9 in which said dryer unit has an outlet opening in the plane of the guide surface, and said cooling system communicates cooling air to said dryer module outlet opening.

11. The invention as in claim 9 including a second dryer unit arranged adjacent to and opposite the first dryer unit for heating opposing sides of the sheets.

12. The invention as in claim 11 wherein the sheets are conveyed through the printing machine in a downstream conveying direction and said first dryer module is arranged opposite and upstream in the conveying direction of said second dryer unit.

13. The invention as in claim 11 wherein the sheets are conveyed through the printing machine in a downstream conveying direction and said first dryer module is arranged opposite and downstream in the conveying direction of said second dryer unit.

* * * * *